US005456393A

United States Patent [19]

Mathis et al.

[11] Patent Number: 5,456,393

[45] Date of Patent: Oct. 10, 1995

[54] ACCESSORY FOR BOOT

[76] Inventors: Ronald J. Mathis, 22 Alice Ct., E. Rockaway, N.Y. 11518; James M. Mathis, 17 Yale Pl., Lynbrook, N.Y. 11563; James Mathis, 4663 Troop K. Rd., Manlius, N.Y. 13104

[21] Appl. No.: 97,065

[22] Filed: Jul. 23, 1993

[51] Int. Cl.[6] ..... A45F 3/60

[52] U.S. Cl. ..... 224/148; 224/401; 224/533; 224/547; 224/926

[58] Field of Search ..... 224/148, 42.45 R, 224/30 A, 32 R, 33 A, 34, 35, 36, 39, 40, 41; 36/136; 280/11.22, 11.23, 811, 809, 816

[56] References Cited

U.S. PATENT DOCUMENTS

| | | | |
|---|---|---|---|
| 3,534,391 | 10/1970 | Bauer | 280/816 |
| 3,859,496 | 1/1975 | Giese | 280/816 |
| 5,148,949 | 9/1992 | Luca | 224/148 |
| 5,257,795 | 11/1993 | Babcock | 280/11.22 |
| 5,344,055 | 9/1994 | Edwards | 224/42.45 R |

*Primary Examiner*—Henry J. Recla
*Assistant Examiner*—David J. Walczak
*Attorney, Agent, or Firm*—Harris Beach & Wilcox

[57] ABSTRACT

A boot having a support mounted along its spine for removably supporting bracket for holding various articles.

9 Claims, 5 Drawing Sheets

ACCESSORY FOR BOOT

BACKGROUND OF THE INVENTION

This invention relates to a boot used in sports and in particular to a boot used in sports that is capable of carrying various articles without impeding the wearer's ability to perform the sport.

Heretofore, boots used in many sporting activities, such as skiing, ice skating, roller skating and the like were made of leather or other flaccid material which provided little structure strength. These types of boots, however, have undergone many changes and improvements over the years. Present day boots typically include a hard high strength molded plastic shell upon which an equally hard high strength plastic collar is mounted for articulation. Both the collar and the shell are separable along the front faces thereof and contain overlapping lips running along the line of separation. Adjustable closure devices are used to draw the shell and the collar snugly, but comfortably against the wearer's foot and lower legs that the boot will respond almost instantaneously to any leg movement.

Clothing worn during these types of activities have also undergone a good deal of change during the same period. The clothing has for the most part become tighter fitting and as a consequence, there is little room to carry articles on one's person. In the case of roller skating, bathing attire is mostly worn when skating in warmer weather, again limiting what the skater can reasonably carry.

Carrying articles on one's person while skiing or skating can lead to serious injury in case of a fall. The article can be driven, upon impact with the ground or ice, into the person's body with great force. As a consequence, people tend to leave such articles as car keys, money and the like behind in unsafe places when partaking in these sports. It is not uncommon to find the articles missing upon returning from the activity.

OBJECTS AND SUMMARY OF THE INVENTION

It is an object of the present invention to improve boots worn when skiing, roller skating, ice skating and the like.

It is a further object of the present invention to provide a device for carrying various articles that can be attached to a boot used in sporting activities in such a way that the ability of the wearer is not impaired.

It is another object of the present invention to provide a carrying bracket that can be removably secured to boots used in a sporting activity.

Yet another object of the present invention is to eliminate the need of a person pursuing certain sports activities to carry articles on his or her person.

A still further object of the present invention is to allow a person participating in certain sports to safely carry articles in a manner to avoid injury in case of a fall.

These and other objects of the present invention are attained by means of a boot having a high strength plastic shell having a sole plate running along its bottom surface. A support plate is affixed to the vertically disposed back section of the shell. A bracket arranged to carry various types of articles is attached to the support plate. In one embodiment of the invention the bracket is adapted to carry a water bottle while in another embodiment the bracket is adapted to carry a pouch. In a still further embodiment of the invention, the support plate is removably secured to the boot.

Another object of the invention is to permit a skater free use of his or her hands when working out while still being able to safely carry various articles.

BRIEF DESCRIPTION OF THE DRAWINGS

For a better understanding of these and other objects of the invention, reference will be made to the following detailed description of the invention which is to be read in association with the accompanying drawings, wherein.

DETAILED DESCRIPTION OF THE INVENTION

Figure 1:
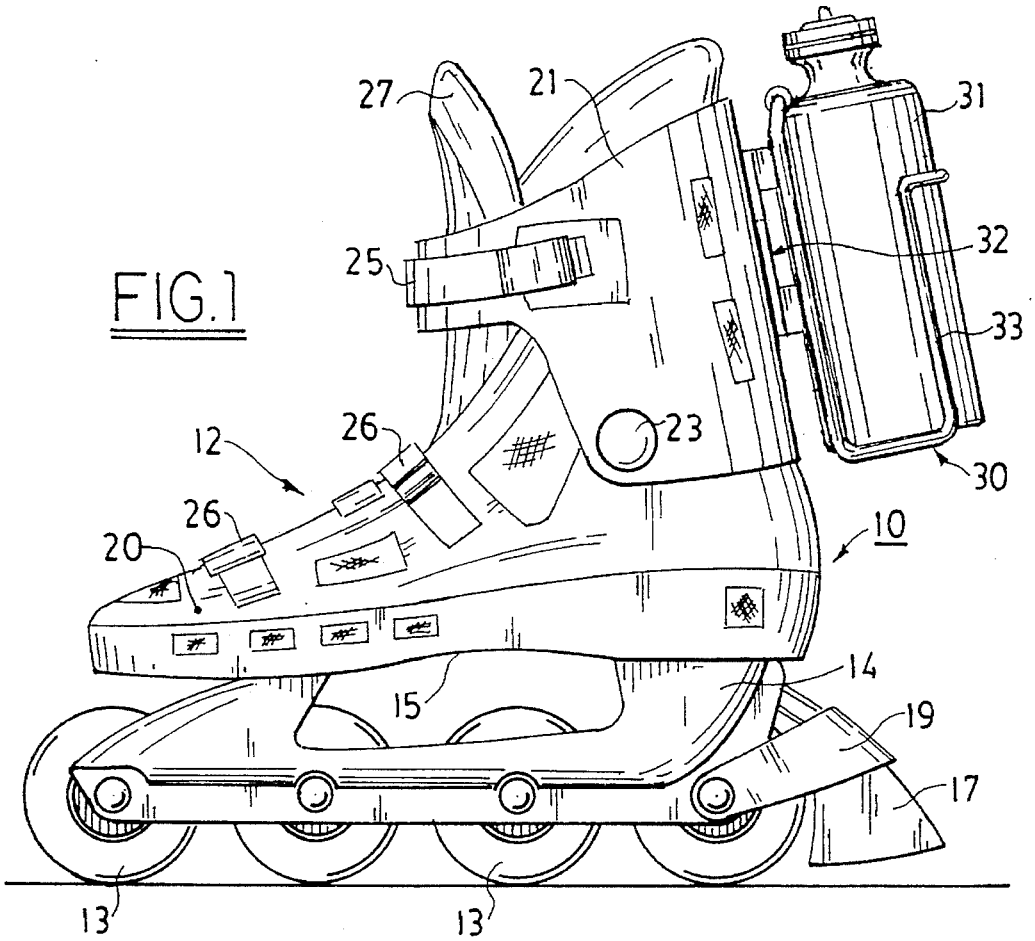
FIG. 1 is a side elevation illustrating one embodiment of the invention in which a liquid container is mounted in a bracket affixed to the back of the skate.

FIG. 1 illustrates a roller skate, generally referenced 10 that embodies the teachings of the present invention. The skate includes a boot 12 having a plurality of inline rollers or wheels 13—13 mounted for rotation within a frame 14. The frame, in turn, is attached by any suitable means to the sole plate 15 of the boot. A brake 17 is attached to the back of the frame by means of a brake mount 19. The boot is of typical two piece construction and includes a high strength plastic or leather shell 20 and a plastic or leather collar 21. The collar is mounted upon the shell by means of rotors 23 so that the collar can turn about the rotors in response to flexing of the wearer's leg about the ankle.

Both the shell and collar are separated along the front of the boot to permit ease of entry of the wearer's foot and lower leg. Each is provided with a lip that overlies the opening and adjustable closures 25 and 26 that function to tighten the boot about the foot and leg. A soft liner 27 is contained within the boot to insure a proper fit and additional comfort.

The collar 21 of the skate is equipped with a flexible wire bracket 30 that supports a plastic bottle 31 capable of containing a liquid such as water. As will be explained in greater detail below, the bracket is removably attached to the back of the boot by means of a support member 32. As can be seen, the bottle is carried on the boot in a location where it will not interfere with the wearer's ability to perform the skating exercise. Also, in the event of a fall, the bottles will not come in contact with the leg and thus poses little or no danger to the user. The bottle is removed from the bracket by simply pushing this bottle rearwardly against the biasing action of the upraised arms 33—33. The arms are moved back a sufficient distance to permit the bottle to be pulled upwardly over the roller 35. The bottle is returned to the bracket in a similar manner.

Figure 2:
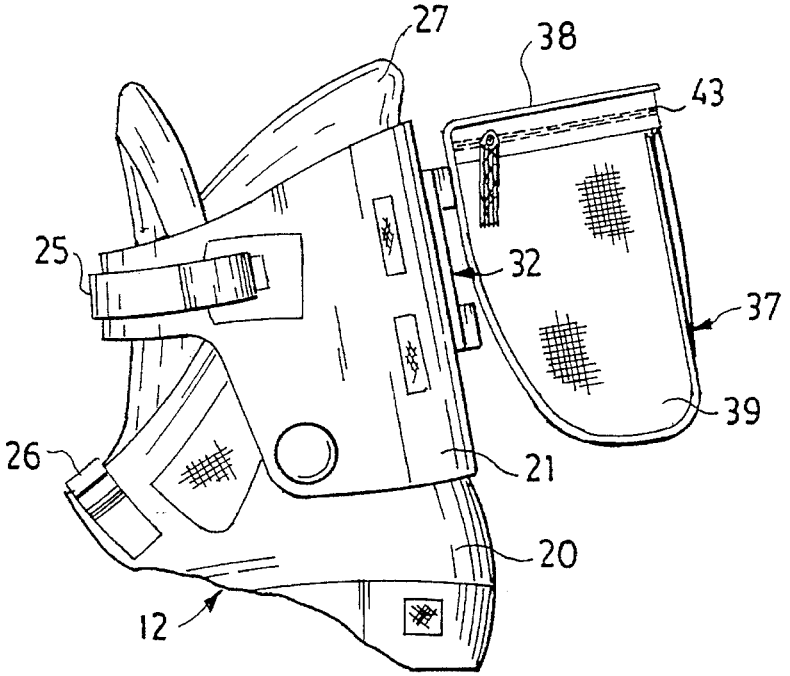
FIG. 2 is a partial side elevation showing another embodiment of the invention in which a pouch is mounted in a bracket affixed to the back of the skate.
Figure 8:
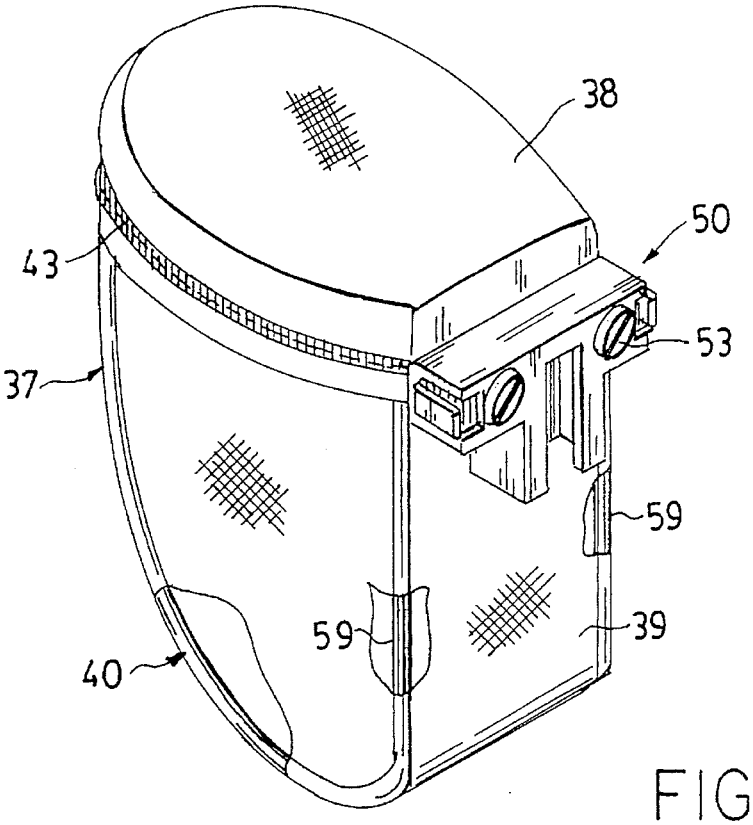
FIG. 8 is a perspective view of the pouch shown in FIG. 2 further illustrating a clasp secured to the pouch bracket.

In FIG. 2 the bracket 30 for holding the bottle has been removed from the support member 32 and replaced with a pouch 37. The pouch has a top lid 38 that is hinged to the body 39 of the pouch and closed thereagainst by means of a zipper 43. The pouch is fabricated from a light-weight material such as nylon that is stretched over a wire frame bracket 40. (FIG. 8).

Figure 9:
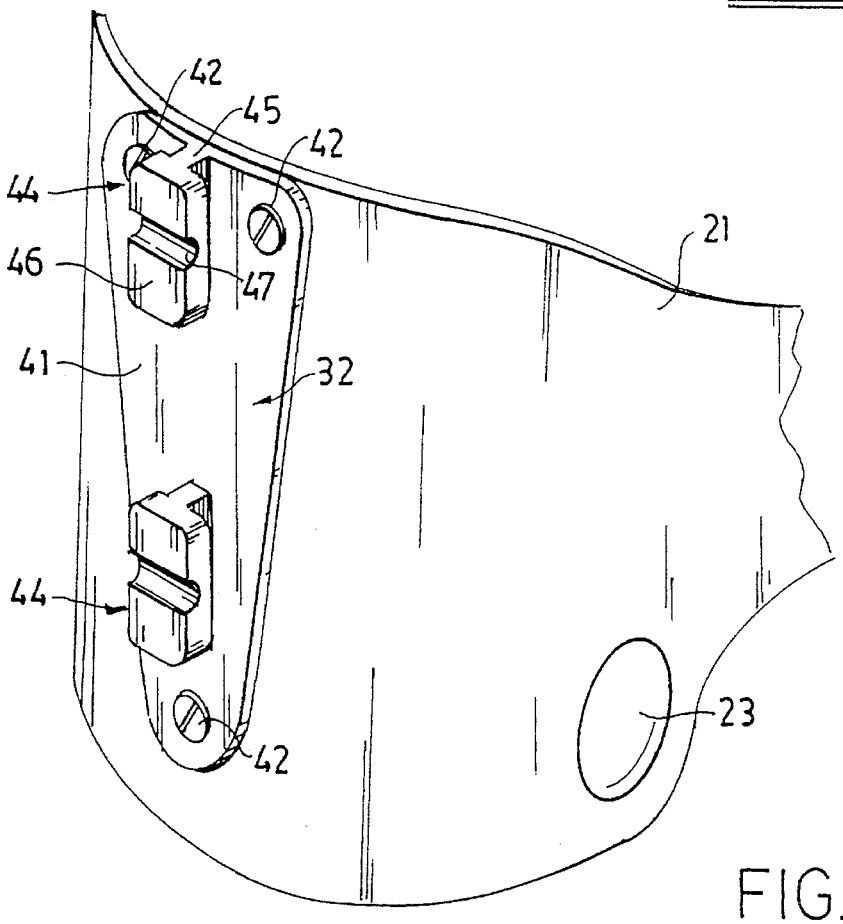
FIG. 9 is an enlarged partial perspective showing a bracket support plate fastened to the collar of a boot.

Turning now to FIG. 9, the support member 32 includes a plate 41 that is secured to the back of the collar 21 by means of threaded fasteners 42—42 or by any suitable adhesive such as an epoxy resin. A pair of T-shaped lugs 44—44 are mounted in spaced apart vertical alignment on the plate. Each lug contains a central leg 45 and an expanded head 46. A horizontally disposed groove 47 is provided in the front face of the head.

The lugs are adapted to receive thereon manually operated clasps 50—50 that are secured to the bottle bracket 30 and the pouch bracket 40.

Figure 7:
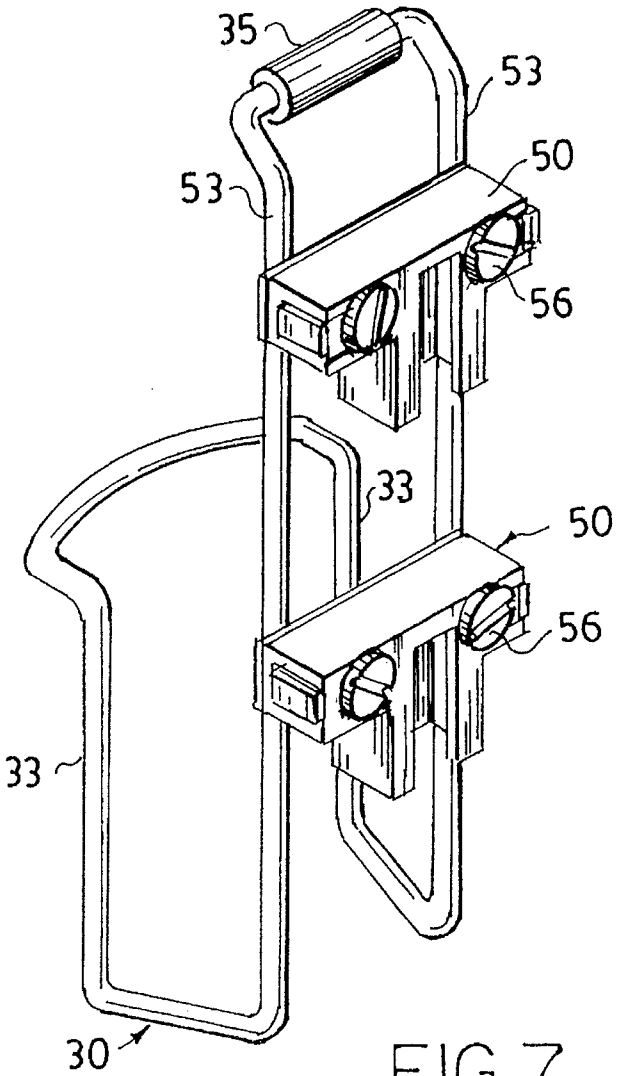
FIG. 7 is an exploded view showing the bracket and clasps shown in FIG. 6 assembled.
Figure 6:
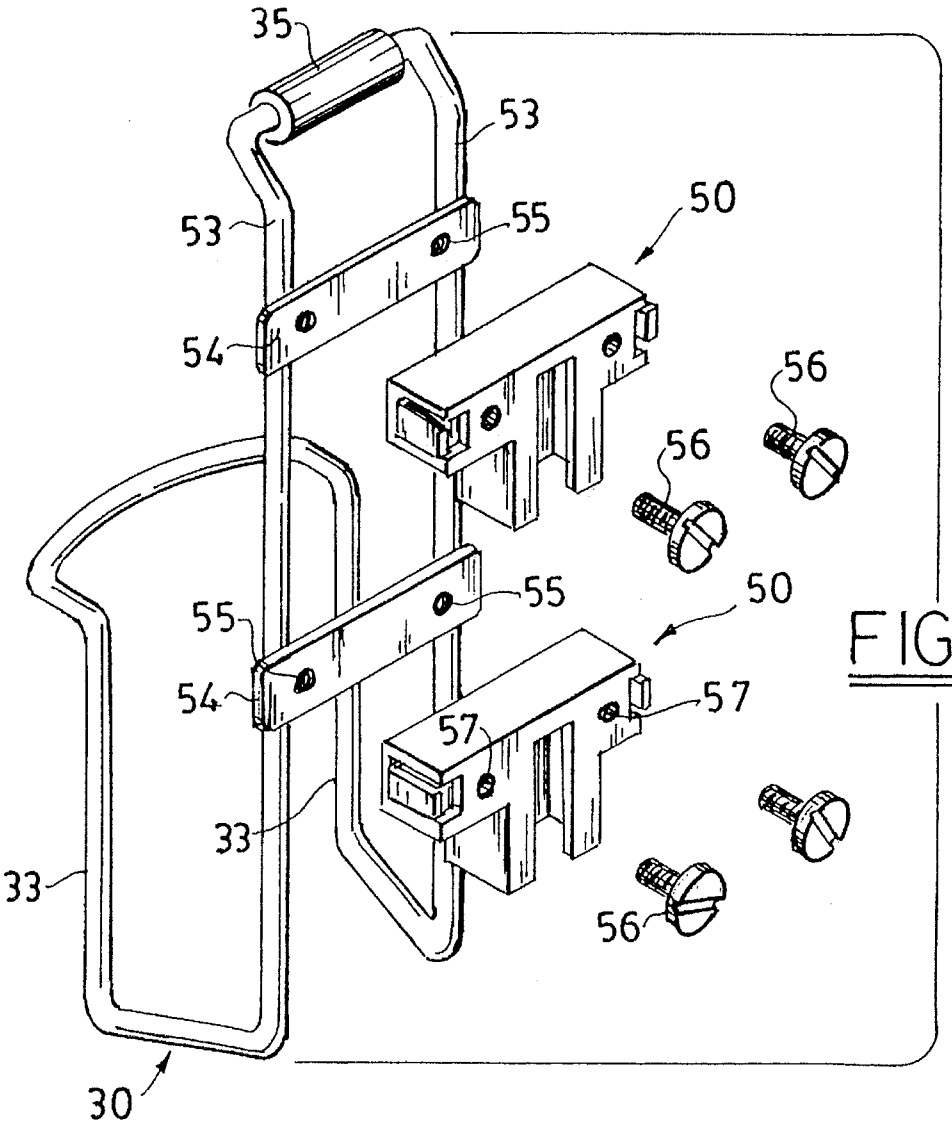
FIG. 6 is an exploded view in perspective showing a bracket and a pair of clasps that are secured to the bracket.

The bottle bracket 30 is shown in greater detail in FIGS. 6 and 7. The bracket is formed as shown from a single piece of spring wire and includes the previously noted biasing arms 33—33 and a pair of upraised elongated mounting members 53—53. A pair of spaced apart parallel bars 54—54 are secured between the upraised mounting members by any suitable means. Each bar contains threaded holes 55—55 that are adapted to receive threaded fasteners 56—56. The fasteners are passed through clearance holes 57—57 formed in the clasps 50—50 and threaded into the bars to secure the clasps to the bracket as shown in FIG. 7.

The pouch bracket 40 is similarly equipped with a wire frame having a pair of upraised mounting members 59—59 (FIG. 8). Although not shown, a bar similar to bar 54 (FIG. 6) is mounted between the member 59—59 at the top of the pouch and a single clasp 50 is secured to the bar using threaded fasteners 53—53.

Figure 3:
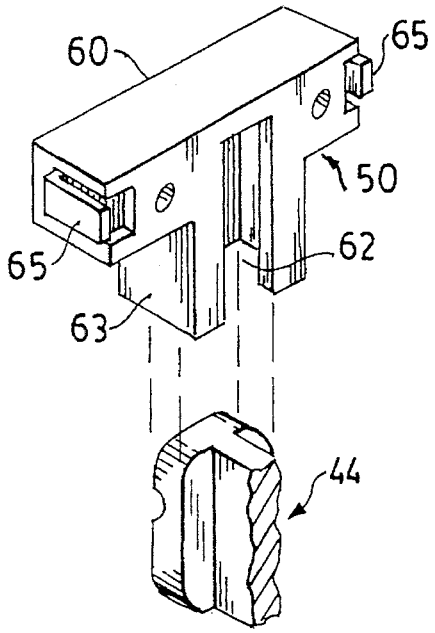
FIG. 3 is a partial perspective view showing a clasp for removably attaching the bracket to the skate.
Figure 4A:
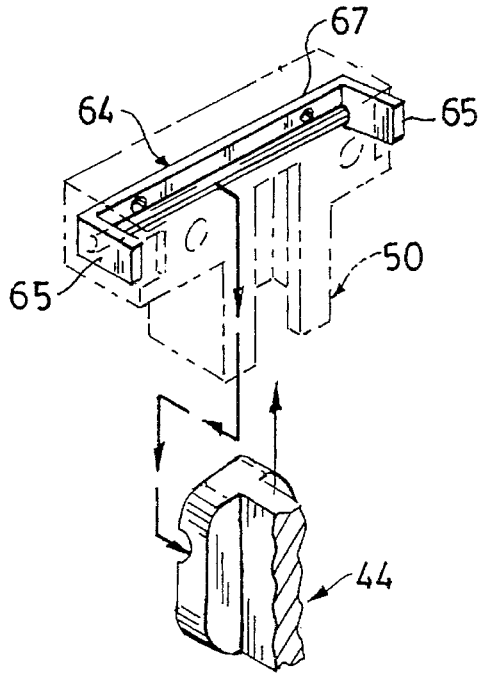
FIGS. 4*a* and 4B illustrate the manner by which the clasp engages a lug secured to the back of the skate.
Figure 5A:
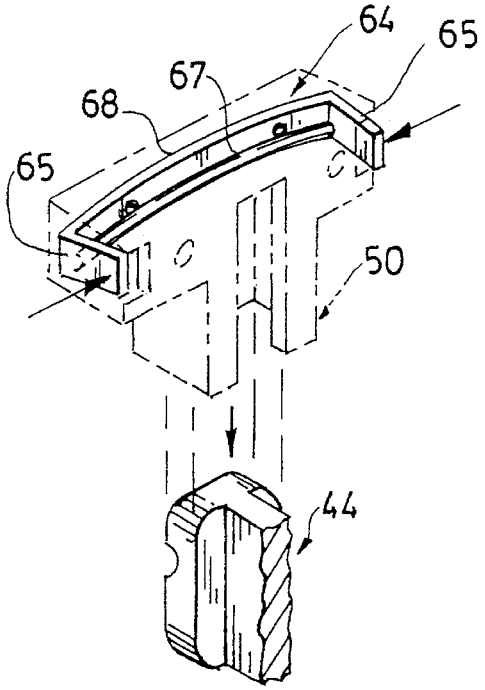
FIGS. 5A and 5B illustrates the manner by which the clasp is released from the lug secured to the back of the skate.
Figure 4B:
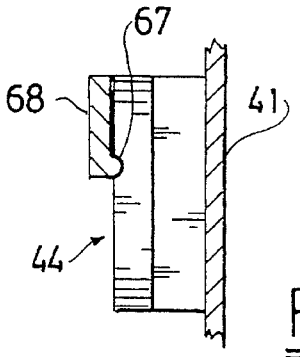
Figure 5B:
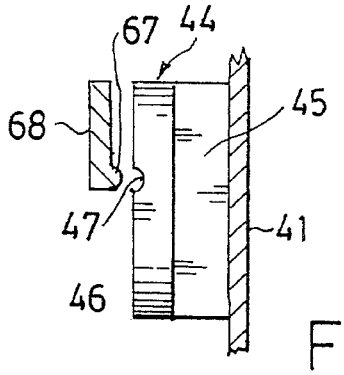

Each clasp 50 includes a T-shaped housing 60 (FIG. 3) containing a T-shaped slotted opening passing upwardly through the central leg 63. The opening is adapted to receive therein one of the lugs 44. A flexible U-shaped locking frame 64 is mounted inside the housing and secured to the housing by suitable means so that the two opposed legs 65—65 of the frame can be urged inwardly toward each other as shown in FIG. 5A. An elongated detent 67 is attached to the base 68 of the frame and bends with the base as the opposing legs are moved inwardly toward each other. In operation, the clasp is passed over the lug as shown in FIG. 4A and the detent is moved back by engaging the two legs between fingers and moving them inwardly. This allows the lug to move past the detent as shown in FIG. 5B. The top of the lug is arrested against the top of the housing opening which places the groove 47 of the lug in horizontal alignment with the detent. Removing the biasing pressure on the legs releases the detent thus permitting it to move into the groove to lock the lugs within the clasp. To remove the lug from the clasp, the above noted procedure is simply reversed.

Figure 10:
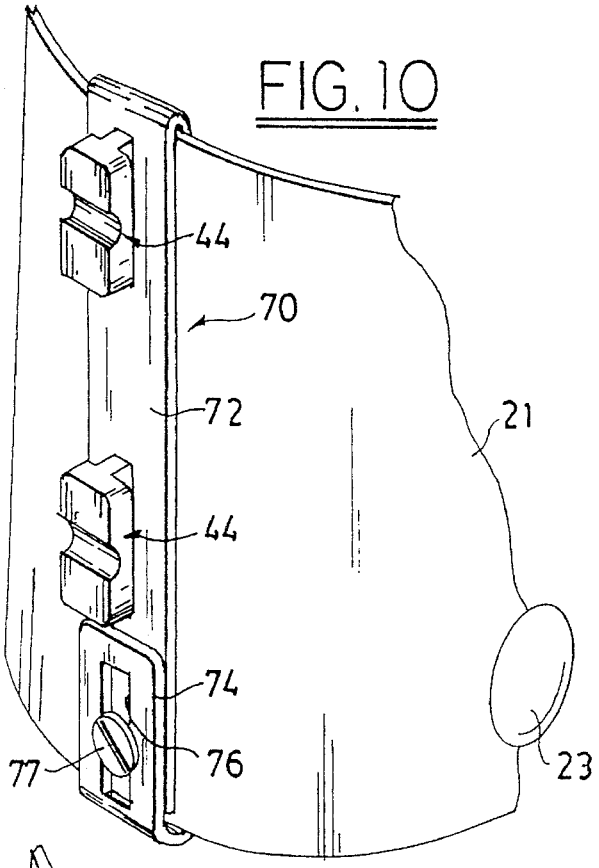
FIG. 10 is a further enlarged partial perspective showing a removable bracket support clamped to the collar of a boot.
Figure 11:
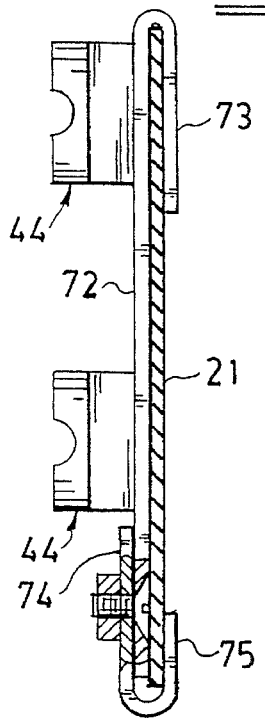
FIG. 11 is a section taken through the collar of FIG. 10.

Turning now to FIGS. 10 and 11 there is shown a further embodiment of the invention in which the lugs 44—44 are mounted on a clamping mechanism 70 that is removably secured to the collar 21 of the boot. The clamping mechanism includes an upper plate 72 that terminates with a hook member 73 and a lower plate 74 that also terminates with a hook member 75, The lower plates contain an elongated slotted hole 76. A screw 77 rides in the slotted hole and is threaded into the upper plate. In assembly, the hook members of the clamping mechanism are passed over the top and bottom edges of the boot collar and the two plates brought together to lock the clamping mechanism against the collar as shown. The screw is then tightened to hold the clamp locked to the boot collar. Here again, the clamping mechanism contains two vertically aligned lugs which can receive a bracket containing either one or two clasps.

Figure 12:
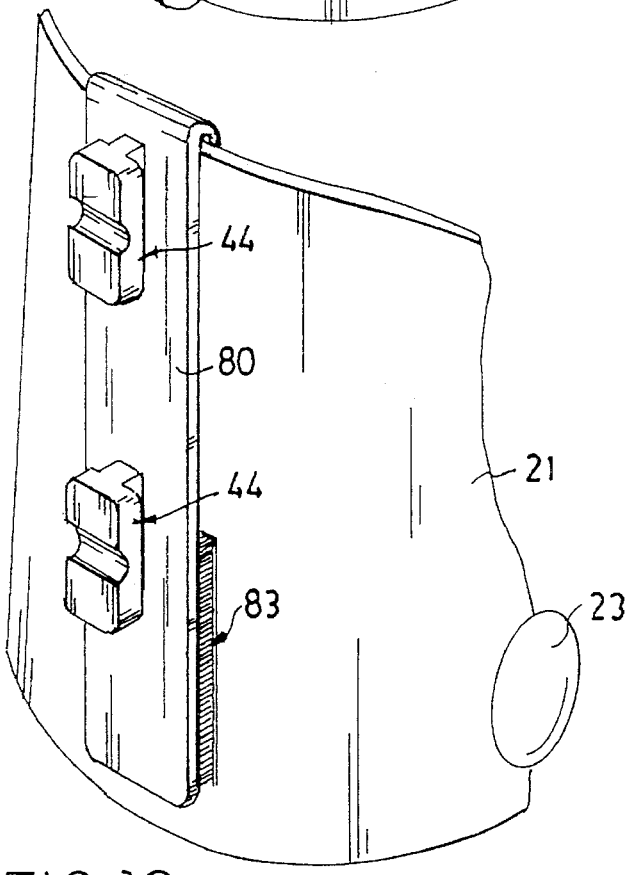
FIG. 12 is a still further enlarged partial perspective showing another means for removably mounting the bracket support to the collar.
Figure 13:
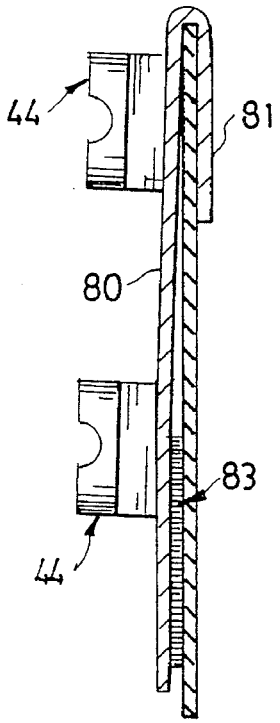
FIG. 13 is a section taken through the collar of FIG. 12.

FIGS. 12 and 13 show a still further embodiment of the invention that includes a support plate 80 that contains an upper hook 81 that is adapted to pass behind the top edge of the boot collar 21. Here again, a pair of vertically aligned lugs 44 are mounted upon the plate. A Velcro fastener 83 is used to removably attach the lower part of the plate to the boot collar. The fastener includes a hook pad and a loop pad with one pad being affixed to the collar and the other to the back of the plate. In assembly, the hook is positioned against the top edge of the collar and the two pads of the Velcro fastener are brought together to removably secure the support plate to the back of the boot.

While this invention has been described with specific reference to an inline roller skate, it is not limited to this specific application. For example, the need for a support plate can be eliminated by molding the lug as part of the boot or collar. In addition, the apparatus of the present invention can be used in association with other types of boots used in skiing and ice skating activities and is not confined to the details set forth above and this invention is intended to cover any modifications and changes as may come within the scope of the following claims:

What is claimed is:

1. In a boot having a plastic shell containing a front, a back, a top, and a first closure means at the front of the shell and a spine at the back of the shell and a collar mounted upon the shell, said collar having a top and a bottom edge and being arranged to wrap around the top of the shell and further having a second front closure means and a back section that is aligned along the spine of the shell, the improvement comprising a support means removably secured to said collar;

lug means mounted upon the support means, and an interchangeable bracket means for removably engaging said lug means and further including a water bottle removably mounted in said bracket means and a biasing means for holding the bottle within said bracket means.

2. In a boot having a plastic shell containing a front, a back and a top, and a first closure means at the front of the shell and a spine at the back of the shell and a collar mounted upon the shell, said collar having a top and a bottom edge and being arranged to wrap around the top of the shell and further having a second front closure means that is aligned along the spine of the shell, the improvement comprising;

a support means removably secured to said collar, a lug means mounted upon said support means, and an interchangeable bracket means for removably engaging said lug means, wherein said bracket means further includes a pouch means secured thereto said pouch means further including a zipper means for closing a hinged lid to said pouch.

3. The boot of claim 1 wherein said support means further includes a pair of adjustable clamping jaws having hook means for passing under the top and bottom edges of said collar.

4. The boot of claim 3 wherein said clamping jaws further include a pair of vertically disposed plates slidably mounted one on top of the other, each plate terminating at one end in a hook member and threaded means for adjustably securing one plate to the other.

5. The boot of claim 1 wherein said support means includes a vertically disposed plate having a hook member at a top end thereof that passes beneath a top edge of said collar and a hook and loop fastener at a bottom end of the plate for securing the plate to the spine of the boot.

6. A roller skate that includes:

a boot that further includes a plastic shell having a vertically disposed spine and an upper collar mounted for articulation on the shell, said boot further including a horizontal sole plate and a plurality of in-line wheels secured to the sole plate, clamping means having a pair of opposed hook members arranged to pass under a top edge and a bottom edge of said collar whereby the clamping means can be secured to said boot, and coupling means for removably securing a bracket to said clamping means.

7. The roller skate of claim 6 wherein said bracket means further support an article.

8. The roller skate of claim 7 wherein said article is a water bottle.

9. The roller skate of claim 7 wherein said article is a pouch.

* * * * *